US005335437A

United States Patent [19]

Andersen

[11] Patent Number: 5,335,437

[45] Date of Patent: Aug. 9, 1994

[54] GUN HAMMER

[76] Inventor: Frank B. Andersen, 589 Noowick Rd., R.R. #1, Millbay, B.C., Canada, V0R 2P0

[21] Appl. No.: 35,277

[22] Filed: Mar. 22, 1993

[51] Int. Cl.[5] ..... F41A 17/74

[52] U.S. Cl. ..... 42/70.08; 42/69.01

[58] Field of Search ..... 42/69.01, 70.08, 66

[56] References Cited

U.S. PATENT DOCUMENTS

| | | | |
|---|---|---|---|
| 624,321 | 5/1899 | Fyrberg | 42/70.08 |
| 644,660 | 3/1900 | Caldwell | 42/70.08 |
| 3,624,947 | 12/1971 | Worrall | 42/70.08 |
| 3,748,771 | 7/1973 | Piscetta | 42/66 |
| 4,090,316 | 5/1978 | Volkmar | 42/70.08 |
| 4,316,341 | 2/1982 | Landry | 42/66 |
| 4,615,133 | 10/1986 | Center | 42/69.01 |
| 4,962,606 | 10/1990 | Pozzi | 42/70.08 |

*Primary Examiner*—David H. Brown

[57] ABSTRACT

A gun hammer has a striking surface on the hammer's face which automatically withdraws inside the body of the hammer when pressure is applied by the gun user's finger or thumb to the hammer's spur. The possibility of the firearm accidentally discharging during decocking is eliminated.

2 Claims, 4 Drawing Sheets

GUN HAMMER

BACKGROUND OF THE INVENTION

1. Field of the Invention

The present invention relates generally to firearms, and more particularly, to a gun hammer especially adapted such that the gun can be safely decocked without the possibility of accidental discharge.

2. Description of the Prior Art

Safety devices in the form of safety locks are well known in the art of guns and other firearms. For example, U.S. Pat. No. 4,914,846 discloses a hammer locking device for guns. U.S. Pat. No. 3,624,947 discloses a hammer safety for firearms. U.S. Pat. No. 4,962,606 also discloses a hammer safety for firearms. FIG. 1 shows the '606 type of hammer safety.

Thus, while the foregoing body of prior art indicates it to be well known to use safety devices for firearms including hammer safeties, the provision of a more simple and cost effective device is not contemplated. Nor does the prior art described above teach or suggest a gun hammer device which may be used by individuals to automatically prevent the accidental discharging of a gun while decocking it. The foregoing disadvantages are overcome by the unique gun hammer of the present invention as will be made apparent from the following description thereof. Other advantages of the present invention over the prior art also will be rendered evident.

SUMMARY OF THE INVENTION

To achieve the foregoing and other advantages, the present invention, briefly described, provides a gun hammer having a striking surface on the hammer's face which automatically withdraws inside the body of the hammer when pressure is applied by the gun user's finger or thumb to the hammer's spur. The possibility of the firearm accidentally discharging during decocking is eliminated.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least two of the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved gun hammer which has all of the advantages of the prior art and none of the disadvantages.

It is another object of the present invention to provide a new and improved gun hammer which may be easily and efficiently manufactured and marketed.

It is a further objective of the present invention to provide a new and improved gun hammer which is of durable and reliable construction.

An even further object of the present invention is to provide a new and improved gun hammer which is susceptible of a low cost of manufacture with regard to both materials and labor, and which accordingly is then susceptible of low prices of sale to the consuming public, thereby making such gun hammer available to the buying public.

Still yet a further object of the present invention is to provide a new and improved gun hammer having a striking surface on the hammer's face which automatically withdraws inside the body of the hammer when pressure is applied by the gun user's finger or thumb to the hammer's spur.

It is still a further object of the present invention to provide a new and improved gun hammer which eliminates the possibility of the firearm accidentally discharging during decocking.

Still a further object of the present invention is to provide a new and improved gun hammer including means for locking and unlocking the hammer into and out of, respectively, the safety position.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
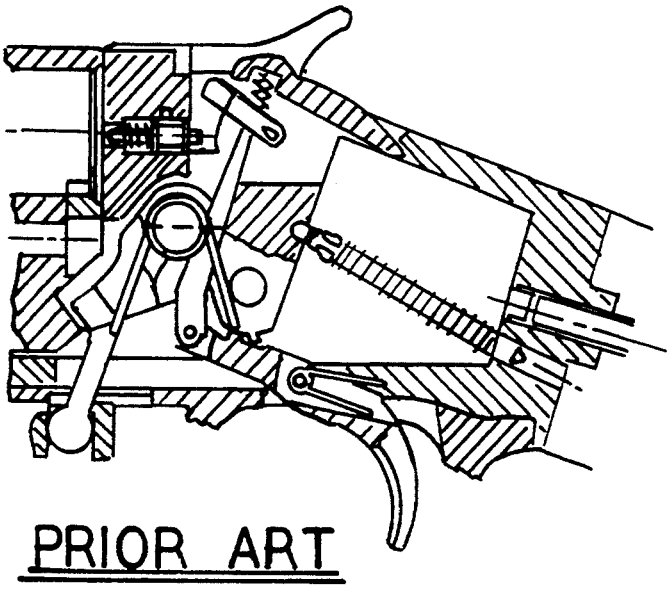
FIG 1 PRIOR ART
FIG. 1 is a cross-sectional view of a prior art gun having a hammer safety.
Figure 2:
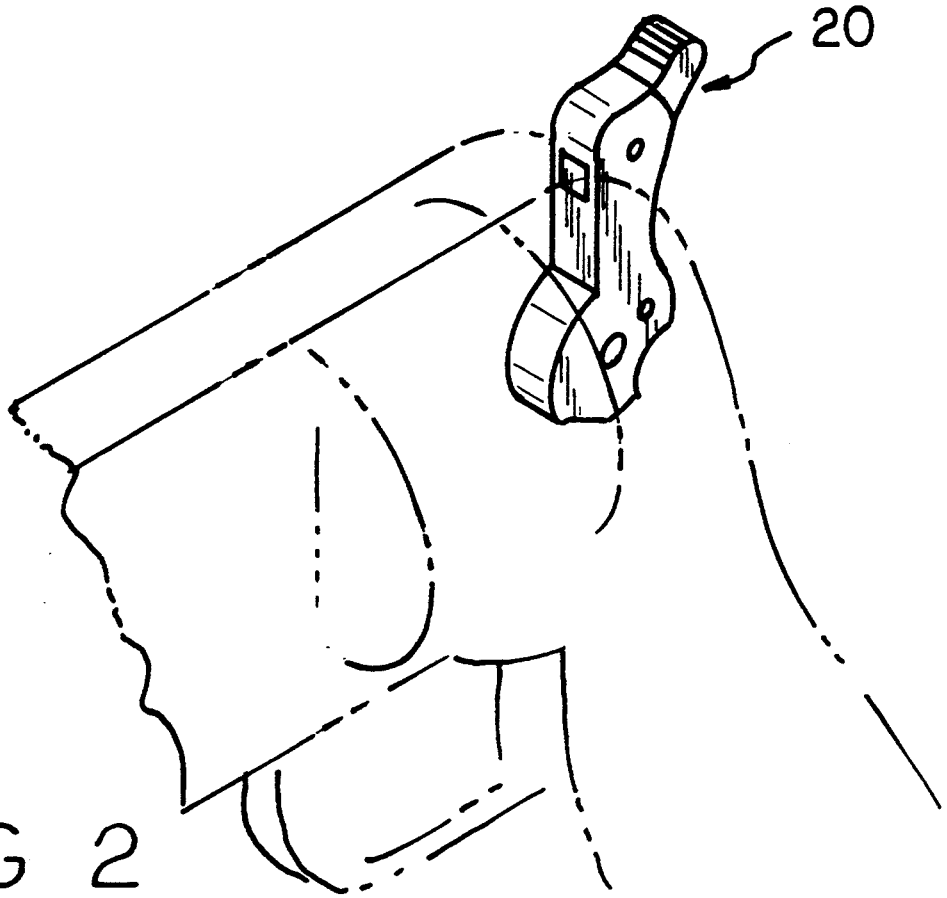
FIG. 2 is a perspective view showing a gun utilizing the first preferred embodiment of the gun hammer of the present invention.

With reference now to the drawings, a new and improved gun hammer embodying the principles and concepts of the present invention will be described.

Turning initially to FIGS. 2–5, there is shown a first exemplary embodiment of the gun hammer of the invention generally designated by reference numeral 20. In its preferred form, gun hammer assembly 20 comprises generally hammer body 30 and spur/strike face combination piece 40, along with plunger 62, spring 64 (the spring 64 and plunger 62 can be held in a hole drilled in the hammer body), and pin 66 (see particularly FIG. 5).

Hammer body 30 has a square hole 32 in its front face 38. Towards the back of and above square hole 32 are a pair of recessed slots **34*a* and 34*b* in the hammer body 30. Hammer body 30 also has a pin hole 36**.

Spur/strike face combination piece 40 has a firing pin striker section 42 and a hammer spur section 50. The pin striker section 42 has a flat striking surface 44. The pin striker section 42 also has a pair of locking lugs **48*a* and 48*b* located on the upper surface of the striker 42. The first locking lug 48*a* is constructed to mate with the first recessed slot 34*a* in the hammer body 30 (while the hammer 20 is in its firing position). The second locking lug 48*b* is constructed to mate with the second recessed slot 34*b* in hammer body 30 (while the hammer 20** is in its firing position).

The pin striker section 42 preferably has a sloped surface 54 on its underside.

The hammer spur 50 preferably has some type of thumb (or finger) grip 52 such as and preferably a stepped pattern in the metal as shown in the Figures.

Figure 3:
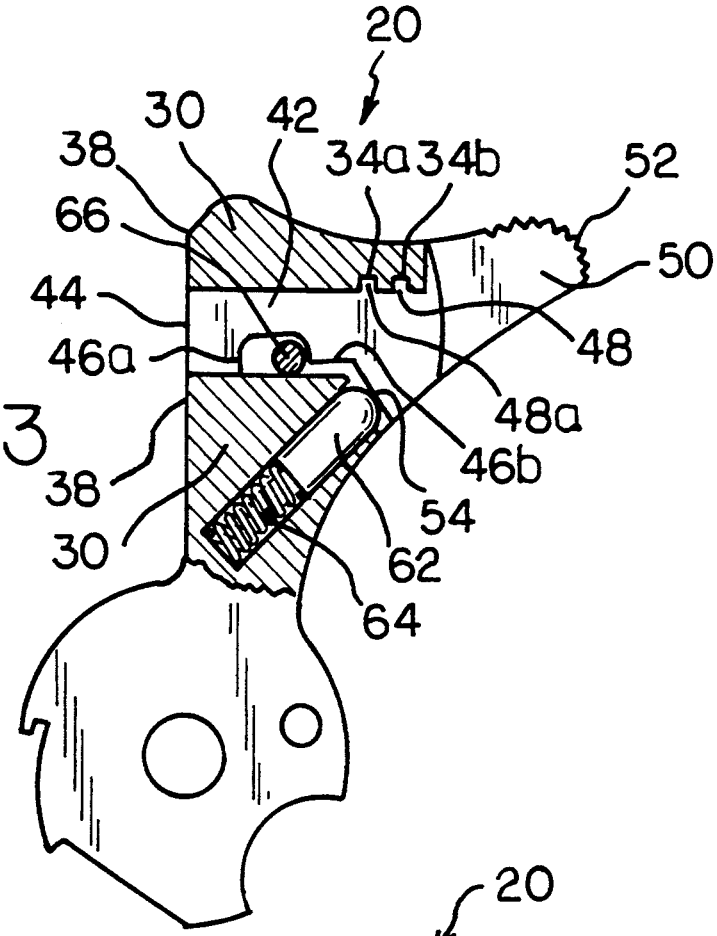
FIG. 3 is a cross-sectional side view of the gun hammer of FIG. 2 in its firing position in accordance with the present invention.

The operation of the hammer 20 of the preferred embodiment is very simple and works automatically. Referring first to FIG. 3 which shows the hammer 20 in its firing position, the firing pin striker 42 fits closely within the square hole 32 in the hammer body 30. The firing pin striker 42 is locked in position within the hammer body 30 by means of the first locking lug **48*a* and the second locking lug 48*b* which are respectively engaged with the first and second recessed slots 34*a* and 34*b* in the hammer body 30. The firing pin striker 42 is maintained in this position by the urging of spring 64 powered plunger 62 pushing on the sloped surface 54 on the underside of the pin striker 42**.

Figure 4:
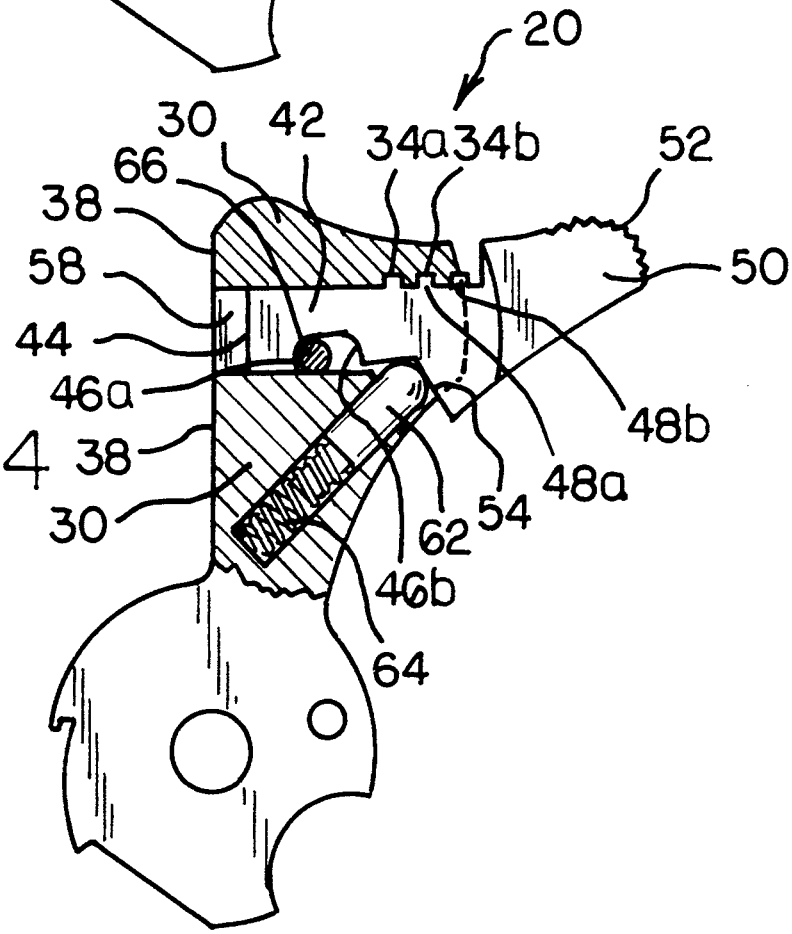
FIG. 4 is a cross-sectional side view of the gun hammer of FIG. 2 locked in its safe non-firing position in accordance with the present invention.
Figure 5:
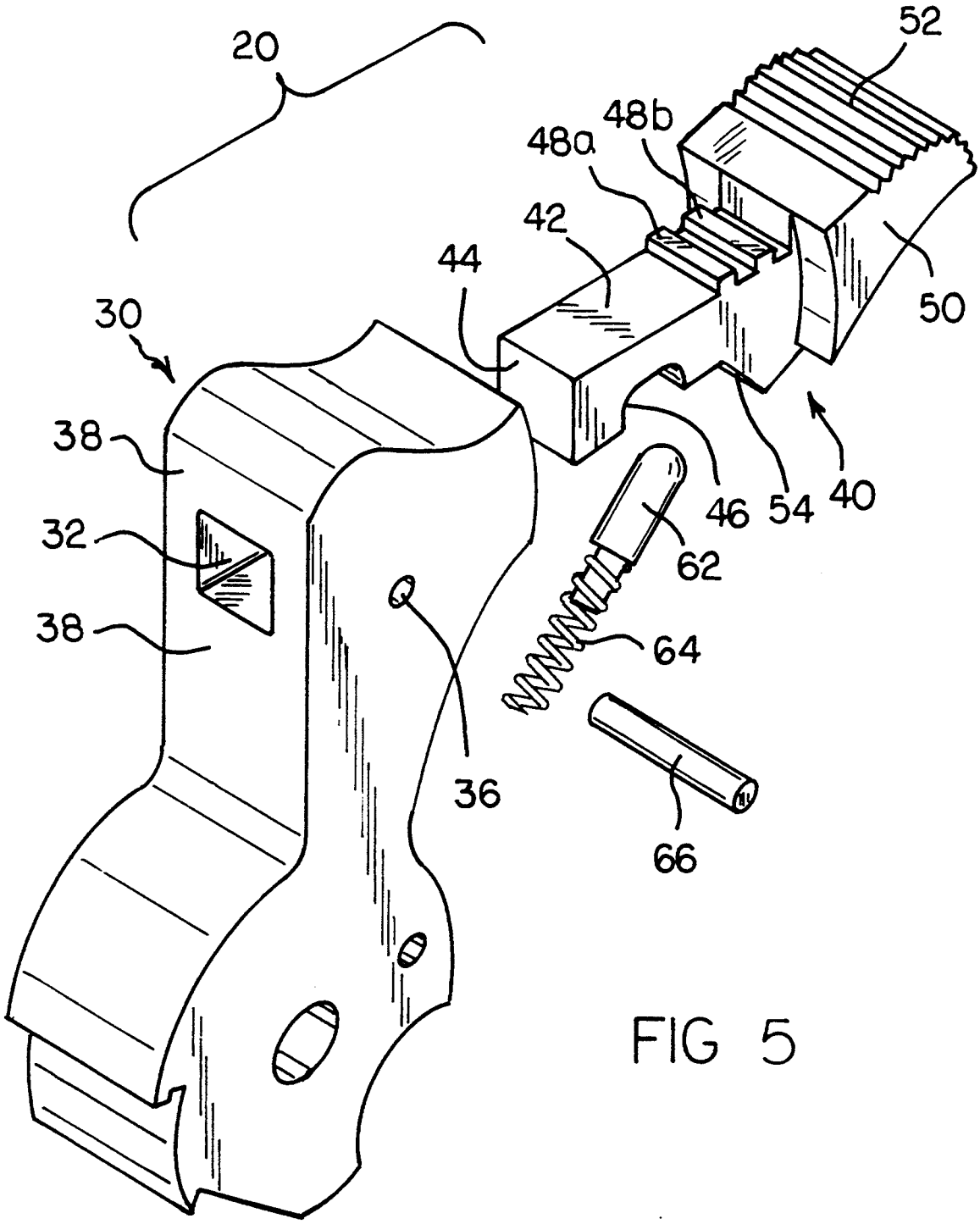
FIG. 5 is a perspective view in elevation of the preferred embodiment of the gun hammer separated into its individual parts in accordance with the present invention.

Now, referring to FIG. 4 which shows the hammer assembly 20 in its safe position, the firing pin striker 42 can be moved into its rearward safe position by applying a downward pressure to the thumb grip 52 of the spur 50. The downward movement disengages first and second locking lugs **48*a* and 48*b* from the first and second recessed slots 34*a* and 34*b*, thus releasing firing pin striker 42 from the hammer body 30. Firing pin striker 42 is then urged outward toward the rear of the hammer body 30 by the force of the spring 64 powered plunger 62. Firing pin striker 42 is stopped in its rearward movement by pin catching surface 46*a* on firing pin striker 42 catching on cross pin 66, which is preferably press fit within a hole drilled through the hammer body 30. Since the firing pin striker 42 can not be moved any farther out, the pressure from spring 64 powered plunger 62 will urge the striker 42 upward when the thumb pressure on the thumb grip 52 is released. First locking lug 48*a* engages with second recessed slot 34*b*, while second locking lug 48*b* moves out past the top rear end of the hammer body 30. The firing pin striker 42 is held in this position at the urging of the spring 64 powered plunger 62**.

While the firing pin striker is in the rearward safe position, flat striking surface 44 at the front of the firing pin striker 42 is withdrawn inside the hammer body 30. An accidental release of the spur will not cause the gun to fire since the withdrawn striker 42 surface 44 leaves a gap 58 because the flat striking surface 44 is not flush with the front face 38 of hammer body 30.

To return the gun into its firing position of FIG. 3, downward and forward pressure is placed on the thumb grip 52 of the hammer spur 50 by the user's thumb. The striker 42 then moves back into the FIG. 3 firing position from which the gun can be fired in its normal fashion.

Figure 6:
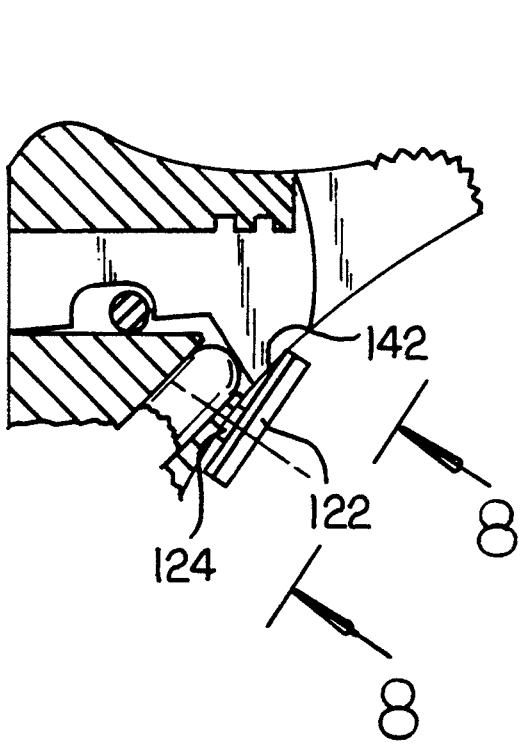
FIG. 6 is a partial cross-sectional view of the second preferred embodiment of the present invention showing the hammer in the firing position in accordance with the present invention.
Figure 7:
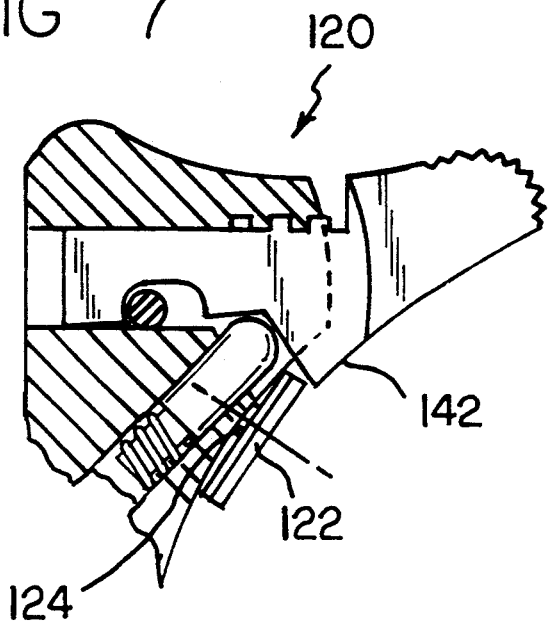
FIG. 7 is a partial cross-sectional view of the second preferred embodiment of FIG. 6 of the present invention showing the hammer locked in its safe non-firing position.
Figure 8:
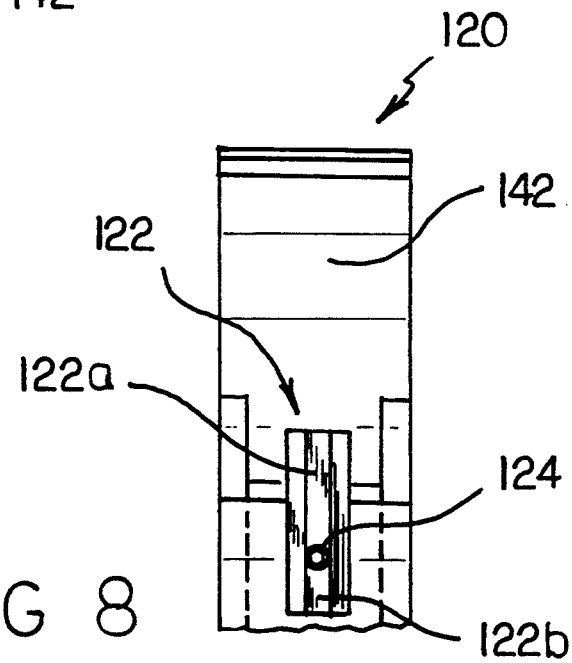
FIG. 8 is a perspective rear view of the gun hammer of the second preferred embodiment of FIGS. 7 and 8 shown in its firing position in accordance with the present invention.

An alternative preferred embodiment of the present invention is shown in FIGS. 6–8. The second embodiment gun hammer assembly 120 is very similar to the first embodiment but also has a rotating lock 122 having a long end **122*a* and a short end 122*b*. The rotating lock 122 is located on the back side 142 of the firing pin striker piece. The lock 122 is held in place by means of pivot screw 124 around which the lock 122 can rotate. The hammer 122 can be locked in the firing position as shown in FIG. 6 by keeping the long end 122*a* of the lock 122 over the back of the striker/spur piece. Rotating the lock 90–270 degrees unlocks the hammer and it can be operated in the same fashion as the first embodiment. When the hammer is placed in the safe position, the short side 122*b*** can be turned up to lock the hammer in the safe position. Rotating the lock approximately 90 degrees again allows the hammer to be used in the same fashion as in the first embodiment. The lock can be used and not used as is desired.

It is apparent from the above that the present invention accomplishes all of the objectives set forth by providing a new and improved gun hammer assembly made up of: a main hammer body having a hole running through the length of the hammer body; a combined spur and strikeface piece having a spur at one end and a strikeface at the opposite end which at least partially fits within the hole in the main hammer body and which is able to slide within the hole in the hammer body between a firing position flush with the front of the main hammer body and a safe position inwardly offset from the front of the hammer body; a forcing means which urges the combined piece upward against the top of the hole in the main hammer body; whereby pressure on the spur of the combined piece can move the strike face between the firing position and the safe position. The combined piece can be alternately held in the safe and firing positions by a holding means which could be made up of at least two recessed slots in the main hammer body which engage with at least two locking lugs in the combination piece. The combined piece can be alternately locked in the safe and firing positions by a locking means, such as a rotating lock.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A new and improved gun hammer assembly comprising:

a main hammer body having a hole running through the length of the hammer body;

a combined spur and strikeface piece having a spur at one end and a strikeface at the opposite end which at least partially fits within the hole in said main hammer body and which is adapted to slide within the hole in said hammer body between a firing position flush with the front of said main hammer body and a safe position inwardly offset from the front of said hammer body;

first holding means on said main hammer body;

second holding means on said combined spur and strikeface piece adapted to engage said first holding means in a first position wherein said strikeface piece assumes a firing position within said hole flush with the front of said main hammer body and in a second position wherein said strikeface piece assumes a safe position within said hole inwardly offset the front of said main hammer body;

a forcing means which urges said second holding means to engage said first holding means;

whereby pressure on said spur of said combined piece is adapted to move said strikeface piece relative to said main hammer body between said first firing position and said second safe position against the force provided by said forcing means and cause said second holding means to engage said first holding means.

2. The invention of claim 1 wherein said first holding means is comprised of at least two recessed slots in said main hammer body and wherein said second holding means is comprised of at least two locking lugs in said combination piece adapted to engage said recessed slots in alternate locking positions.

* * * * *